US010065899B1

(12) United States Patent
Luna

(10) Patent No.: US 10,065,899 B1
(45) Date of Patent: Sep. 4, 2018

(54) PACKAGED GRANULATED EXPLOSIVE EMULSION

(71) Applicant: EXSA S.A., Lima (PE)

(72) Inventor: Karl Maslo Luna, Lima (PE)

(73) Assignee: EXSA S.A., Lima (PE)

( * ) Notice: Subject to any disclaimer, the term of this patent is extended or adjusted under 35 U.S.C. 154(b) by 0 days.

(21) Appl. No.: 15/814,567

(22) Filed: Nov. 16, 2017

(30) Foreign Application Priority Data

Sep. 21, 2017 (PE) ..... 1581-2017/DIN

(51) Int. Cl.

| | |
|---|---|
| ***C06B 31/00*** | (2006.01) |
| ***C06B 31/28*** | (2006.01) |
| ***C06B 31/30*** | (2006.01) |
| ***C06B 31/02*** | (2006.01) |
| ***D03D 23/00*** | (2006.01) |
| ***D03D 43/00*** | (2006.01) |
| ***C06B 45/02*** | (2006.01) |
| ***C06C 7/02*** | (2006.01) |
| ***C06B 43/00*** | (2006.01) |
| ***C06B 21/00*** | (2006.01) |
| ***C06B 47/14*** | (2006.01) |

(52) U.S. Cl.
CPC ..... *C06B 31/30* (2013.01); *C06B 21/0066* (2013.01); *C06B 43/00* (2013.01); *C06B 45/02* (2013.01); *C06B 47/145* (2013.01); *C06C 7/02* (2013.01)

(58) Field of Classification Search
USPC ..... 149/18, 45, 46, 60, 61, 109.4
See application file for complete search history.

(56) References Cited

U.S. PATENT DOCUMENTS

| | | | | |
|---|---|---|---|---|
| 4,456,492 A * | 6/1984 | Alexander | C06B 47/14 | 149/41 |
| 4,676,849 A * | 6/1987 | Curtin | C06B 21/0008 | 149/109.6 |
| 4,756,776 A * | 7/1988 | Halliday | C06B 21/005 | 102/430 |
| 5,084,117 A * | 1/1992 | Houston | C06B 47/145 | 149/109.6 |

* cited by examiner

*Primary Examiner* — James E McDonough
(74) *Attorney, Agent, or Firm* — Polsinelli PC

(57) ABSTRACT

An explosive mixture of a water-in-oil dispersion (matrix emulsion) and ammonium nitrate granules (prills) of fertilizer grade, mechanically sensitized by microspheres (microballs), of plastic ceramic, glass or mixtures thereof and/or by means of a chemical reaction of bubble generation (gasification), which obtains an explosive composition of greater energy, greater volume of gases, water resistant and sensitive to No. 8 detonator, with a relative density as a cartridge between 0.95 g/cm3 and 1.25 g/cm3, with a detonation rate in an unconfined medium as cartridge in the range from 3500 m/s to 5900 m/s and it is stable for a minimum period of 6 months and where the explosive mixture is used in plastic or paper cartridges (chubs) as a nitrocarbonitrate primer and/or column loading in land blasting (rocks) from soft hardness to very hard in underground mining and/or open pits.

7 Claims, No Drawings

PACKAGED GRANULATED EXPLOSIVE EMULSION

CROSS REFERENCE TO RELATED APPLICATION

This application claims priority to Peruvian Application No. 1581-2017/DIN, filed on Sep. 21, 2017, the entire contents of which is incorporated herein by reference.

SCOPE OF THE EMBODIMENTS OF THE INVENTION

The embodiments of the present invention relate to explosive materials for application in mines by its application as primer for nitrocarbonitrate or as column loading in underground mining.

SUMMARY OF THE EMBODIMENTS OF THE PRESENT INVENTION

The embodiments of the present invention relate to an explosive mixture of a water-in-oil dispersion (matrix emulsion) and fertilizer-grade ammonium nitrate granules (prills), mechanically sensitized by microspheres (microballs) of plastic, ceramic, glass or mixtures thereof and/or by a chemical reaction of bubble generation (gasification) that obtains an explosive composition of greater energy, greater volume of gases, water resistant and sensitive to detonator N° 8, with a relative density as a cartridge between 0.95 g/cm3 and 1.25 g/cm3, with a detonation speed in an unconfined medium as cartridge in the range of 3500 m/s to 5900 m/s and stable for a minimum period of 6 months. The explosive mixture of the embodiments of the present invention is used in plastic or paper cartridges (chubs) as nitrocarbonitrates primer and/or column loading in land blasting (rocks) of soft to very hard hardness in underground mining and/or open pit mining.

BACKGROUND OF THE EMBODIMENTS OF THE PRESENT INVENTION

Blasting is one of the main means of minerals extraction in mining operations. The main purpose of the blasting operation is the rock fragmentation and this requires a large amount of explosives. Explosives release a large amount of energy during the explosion, where only 20-30% is used for rock breakage and displacement, while the rest of this energy is wasted in the environment.

Blasting can be defined as the ignition of an explosives massive charge. The blasting process includes loading the drills made in the bore with an explosive substance, which upon activation causes a shockwave and by means of a reaction, releases gases at high pressure and temperature of an instantaneous form for tearing, fracturing or removing a quantity of material according to the design parameters of the blasting.

The fragmentation of the rocky massif is caused immediately after the detonation. The impact effect of the shockwave and rapidly expanding gases on the drill wall is transferred to the surrounding rock, diffusing through it in the form of waves or forces of compression, causing only elastic deformation, since the rocks are very resistant to compression. When these waves reach the free face in the blasting front they cause tensile stresses on the rock mass between the free face and the drill. If the tensile strength of the rock is exceeded, it breaks in the area of the line of least resistance (burden). In this case, the reflected waves are voltage waves that return to the point of origin creating clefts and cracks of tension from the existing natural weakness planes and points, cracking it deeply (crackled effect).

Almost simultaneously, the volume of released and expanding gases penetrates into the initial cracks by expanding them by wedge action and creating new ones, with which effective rock fragmentation occurs. If the distance between the drill and the free face is correctly calculated, the rock between the two points will yield. Then the remnant gases rapidly move the mass of crushed material forward until it loses its force by cooling and by increasing the volume of the cavity formed in the rock. At this point, the fragments or debris fall and accumulate to form the pile of debris or blasted material.

In order to increase the performance and advance of the detonation fronts in the mine, explosive mixtures with higher energy technical characteristics, higher detonation velocity (resulting in greater detonation pressure and greater brisance or breaking power), resistant to water and greater volume of gases are required. The explosive mixture of the embodiments of the present invention is precisely characterized by having greater energy, greater volume of gases, and sensitivity to the No. 8 detonator and an excellent resistance to water, and since it doesn't contain nitroglycerin presents a better security in its handling and storage.

In the prior art, there are currently explosive mixtures comprising a mixture based on water-in-oil emulsion and ammonium nitrate granules (prills) of technical grade and/or anfo grade. The granules may be coated with petroleum and/or mineral oils. These explosive mixtures may be pumpable or packaged in plastic sleeves or in bags with diameters greater than 2½ inches (6.35 cm), they are not sensitive to No. 8 detonator but to a ⅓ pound (0.73 kg) booster for initiation as column loading.

In general, explosive mixtures of water-in-oil emulsion and granules (prills) of fertilizer-grade ammonium nitrate have the technical advantage with respect to emulsions and dynamites to present higher energy, higher bulk density and higher volume of gases which allows for better rock fragmentation. The problem of explosive mixtures of ammonium nitrate prills with technical grade and/or anfo grade lies in the instability of the explosive mixture due to the hygroscopicity of the ammonium nitrate which tends to adsorb the water found in the dispersed phase of the emulsion and the deterioration of the continuous phase of the emulsion by the action of the anticaking additives of ammonium nitrate based on sodium naphthalene sulfonate (Galoryl), resulting in a decrease in its life time, b) insensitivity to detonator No. #8, c) non-operation in cartridges of ⅞" (0.34 cm) diameter (critical diameter), d) hardening of cartridges, which makes priming difficult and e) decrease in their explosive properties.

In this sense, the Peruvian Patent No. 17-2014/DIN is known in the state of the art which reports an explosive emulsion only for cold climates up to −40° C. comprising: a) aqueous oxidizing solution of inorganic salts comprising, by weight: from 60% to 85% of technical grade ammonium nitrate or fertilizer, from 4% to 18% of technical grade calcium nitrate, from 0.1% to 2% of thiourea and 8% to 15% water; b) continuous combustible phase formed by organic compounds of mineral, animal or vegetable origin of a liquid or solid nature including an agent or a mixture of surfactant agents of ionic and/or polymeric nature comprising, by weight, from 5% to 30% of emulsifier of an ionic nature, from 5% to 30% of emulsifier of a polymeric nature, from 4% to 40% of mineral, vegetable or animal oil, from 10% to 40% of microcrystalline wax, and from 15% to 50% of paraffin; wherein the emulsion sensitized with 1% to 5% by weight of glass microsphere bodies mixed with granular aluminum, and the gasifying agent comprises a solution of oxidizing salt of sodium nitrite having a pH of 5 to 7. Further, it refers to a process for producing the explosive emulsion.

On the other hand, the invention U.S. Pat. No. 4,456,492 is directed to an explosive compound in molten state comprising as the first component a molten mass that can be poured, pumped or flowed at a temperature in the range of −10° C. to +90° C. and comprising at least one oxygen-releasing salt, for example, ammonium nitrate, and at least one mass-soluble combustible material, e.g. urea, and as a second component pre-treated with ammonium nitrate. The explosive compositions show good detonation sensitivity retention under applied static pressure conditions, for example, in deep explosive wells. This composition discloses the use of ammonium nitrate, ammonium nitrate (prills), sodium nitrate, urea, thiourea, water, surfactants and combustibles such as paraffins, waxes, naphthas, among others. Further, it comprises the use of microspheres or microballs. Additionally, it mentions that such explosive compositions can also be used as fillers for explosive cartridges and, therefore, can be used as packaged explosives. However, this prior art teaches that the compositions should have additives for improving detonation sensitization such as formaldehyde condensates and naphthalenesulfonic acids of 1 to 10 carbon atoms, which counteract the possible loss of sensitization of the mixture, but should be used a little because of the high prices of this input.

The technical problems identified in the application in underground and/or open pit mining that are solved with the explosive mixture of greater energy, greater volume of gases, operation in cartridge diameter of ⅞" (2.22 cm), stability at least 6 months and sensitivity to No. 8 detonator of the embodiments of the present invention are:

a) Decrease in life spam.

b) Insensitivity to N° 8 detonator.

c) Not working on ⅞" (2.22) diameter cartridges (critical diameter).

d) Difficulty of priming by hardening of the cartridges by crystallization of the explosive mixture.

e) Reduction of its explosive properties.

In this regard, the above-mentioned technical problems were overcome with the matrix emulsion of the embodiments of the present invention, which is formed by an oxidizing substance and a combustible substance, wherein the oxidizing solution for the embodiments of the present invention contain ammonium nitrate between 55% at 80% by weight as the largest component, sodium nitrate from 0.1% to 16% by weight, thiourea from 0.1% to 3.5% by weight as promoter of the gasification process and water from 6% to 18% % by weight.

BRIEF DESCRIPTION OF THE EMBODIMENTS OF THE PRESENT INVENTION

The embodiments of the present invention relate to an explosive mixture of water-in-oil dispersion (matrix emulsion) and ammonium nitrate granules (prills) of fertilizer grade (density from 0.85 g/cm3 to 1.0 g/cm3), sensitized in a mechanical way by microspheres (microballs) of plastic, ceramic, glass or mixtures thereof and/or by a chemical reaction of bubble generation (gasification) that obtains an explosive composition of greater energy, greater volume of gases, resistant to water and sensitive to detonator No. 8, having a relative density as a cartridge between 0.95 g/cm3 and 1.25 g/cm3, with a detonation rate in an unconfined medium as a cartridge in the range of 3500 m/s to 5900 m/s and stable for a minimum period of 6 months. The explosive mixture of the embodiments of the present invention is used in plastic or paper cartridges (chubs) as nitrocarbonitrates primer and/or column loading in the land blasting (rocks) of soft to very hard hardness in underground mining and/or open pit. The matrix emulsion is formed by an oxidizing solution and a combustible solution, wherein the oxidizing solution comprises water, oxidizing salts of ammonium and/or sodium, thiourea as a promoter of the gasification process. The combustible solution is comprised of hydrocarbons of mineral, animal or vegetable origin of liquid or solid nature which includes an agent or a mixture of surfactant agents of non-ionic and/or polymeric nature.

This matrix emulsion is sensitized by a mechanical mixing with microspheres (microballs) of plastic, ceramic, glass or mixtures thereof. To the microsphere-sensitized matrix emulsion is added ammonium nitrate prills of fertilizer grade (with a density between 0.85 g/cm3 to 1.0 g/cm3) which have been previously treated with a liquid oily solution of a solvent of hydrocarbon based on n-alkane and iso-alkanes of chain C12 to C15, having a density of 0.82 g cm3 at 0.86 g/cm3 and a viscosity of 200 cP, in order to inhibit its reaction with the water of the dispersed phase of the matrix emulsion and to avoid the destabilization of the explosive mixture. Ammonium nitrate (prills) of fertilizer grade is added to the explosive mixture as an agent to increase energy and volume of gases. Finally, the density of the cartridge is reduced by the addition of a chemical substance of oxidizing salts of ionic nature which in contact with the sensitized matrix emulsion form nitrogen bubbles which are occluded within the explosive mixture to obtain homogeneous compositions of density 0.95 g/cm3 to 1.25 g/cm3, stable for a minimum period of 6 months. The explosive mixture obtained has a detonation velocity in the range of 3500 m/s to 5900 m/s homogeneously throughout the cartridge.

This explosive mixture of higher energy, higher detonation velocity and greater volume of detonation gases of the embodiments of the present invention is sensitive to No. 8 detonator and has the physicochemical characteristics as emulsion matrix density between 1.38 g/cm3 to 1.46 g/cm3, pH 3.0 to 6.0, and is capable of being packed in ⅞" (7") and 3" (3.6") chubs cartridges with lengths of 15.24 cm (6") to 60.96 cm (24"), being its transportation, storage and application completely safe in underground mining and/or open pit.

DETAILED DESCRIPTION OF THE EMBODIMENTS OF THE PRESENT INVENTION

The embodiments of the present invention provide an explosive mixture based on a dispersion of water in oil (matrix emulsion) and ammonium nitrate granules (prills) of fertilizer grade, sensitive to No. 8 detonator, with higher energy, higher volume of gases, higher resistance to water with respect to anfo and dynamite. It is presented in plastic or paper cartridges from 22.22 cm (⅞") to 7.62 (3") diameter and lengths of 15.24 cm (6") to 60.96 cm (24"), having relative density as a cartridge of 0.95 g/cm3 to 1.25 g/cm3, a detonation rate in an unconfined medium as a cartridge in the range of 3500 m/s to 5900 m/s and stable during a minimum period of 6 months. The explosive mixture of the embodiments of the present invention is used as a primer for initiation of nitrocarbonitrates and/or as column loading in land blasting (rocks) of soft to very hard hardness in underground mining and/or open pit.

The explosive mixture of the embodiments of the present invention is mechanically sensitized by 0.1% to 3.0% of microspheres (microballs) of plastic, ceramic, glass or mixtures thereof. Another way of sensitization is by a chemical reaction of bubble generation (gasification) with a sodium nitrite gasifying agent which makes it possible to obtain an explosive composition having a density in the range of 0.95 g/cm3 to 1.25 g/cm3. Additionally, the embodiments of the present invention can realize sensitization through a combination of mechanical and chemical sensitization.

The increase in energy and volume of gases is regulated by the addition of ammonium nitrate (prills) of fertilizer grade and the increase in the stability of the explosive mixture for a minimum period of 6 months is obtained by the addition of an 80% oily liquid solution of a hydrocarbon solvent based on n-alkane and iso-alkanes of C12 to C15 chain having a density of 0.82 g/cm3 to 0.86 g/cm3 to the granule of the ammonium nitrate (prills) of fertilizer grade in a ratio of 0.2% to 3% by weight of the total mixture of ammonium nitrate (prills) and hydrocarbon solvent to improve the water resistance of ammonium nitrate and inhibit its reaction with the water of the dispersed phase of the emulsion.

The combustible solution formed by hydrocarbons of mineral, animal origin, where, for example, the hydrocarbon of animal origin is shark oil, anchovy oil, whale oil, cod liver oil, seal oil, lard oil, snake oil and mixtures thereof; or oil of vegetable origin such as, for example, olive oil, soybean oil, palm oil, sunflower oil, cottonseed oil, rapeseed or mustard oil, linseed oil, coconut oil and mixtures thereof, where the hydrocarbons may be in their liquid or solid nature and in mixtures thereof; from 0.1% to 10% by weight, paraffin from 0.1% to 50% by weight, microcrystalline wax from 0.1% to 60% by weight includes an active agent or a mixture of surfactant agents of nonionic or polymeric nature of from 10% to 38% by weight and from 10% to 20% of candelilla wax of solid nature and of vegetable origin with a melting point of 70° C., the solution confers the appropriate consistency with a viscosity of the matrix emulsion of 40000 cP at 150000 cP, which allows the retention of the nitrogen bubbles in the matrix emulsion avoiding its coalescence.

To obtain emulsion matrix, 90% to 95% by weight of oxidizing solution and 5% to 10% of the combustible solution are mixed. The oxidizing solution is between 80° C. to 90° C. and the combustible solution between 70° C. and 90° C. In these conditions they are mixed at a high rotational speed from 400 rpm to 2000 rpm to form the emulsion at a temperature between 70° C. and 90° C. with a particle size from 0.5 microns to 5 microns and with physicochemical characteristics as emulsion matrix of density between 1.38 g/cm3 to 1.46 g/cm3, pH 3.0 to 6.0. Under these conditions, the emulsion is non-explosive, it is mixed with 0.1% to 3.0% by weight of glass microspheres, ceramic, plastic or mixtures thereof to provide sensitivity to the detonator, with 5% to 50% of the mixture of ammonium nitrate granules (prills) of fertilizer grade having a density of 0.85 g/cm3 to 1.0 g/cm3 and 0.2 to 3% of an 80% liquid oily solution of a solvent of hydrocarbon based on n-alkane and isoalkanes of C 12 to C 15 chain. The ammonium nitrate granules (prills) of fertilizer grade are added to increase the energy and volume of gases of the explosive and with 0.2% to 2.5% by weight of the gasifying agent of sodium nitrite oxidizing salts with pH of 6.0 to 8.0 at a temperature of 70° C. to 90° C. obtaining a final explosive sensitive to detonator, packaged in cartridges (chubs) with diameters of 2.22 cm (⅞") to 7.62 cm (3") and length of 15.24 cm3 (6") to 60.96 cm3 (24"), having a density between 0.95 g/cm to 1.25 g/cm for the application as an explosive mixture for blasting in underground mining and open pit.

According to the above, the embodiments of the present invention are directed to an explosive mixture based on a dispersion of water in oil (emulsion) and ammonium nitrate granules (prills) of fertilizer grade, sensitive to No. 8 detonator, of greater energy, greater volume of gases, greater resistance to water with respect to anfo and powdery dynamite. It is presented in plastic or paper cartridges (chubs) with diameters of 2.22 cm (⅞") to 7.62 cm (3") and lengths of 15.24 cm (6") to 60.96 cm (24"), having a relative density as cartridge between 0, 95 g/cm3 a 1, 25 g/cm3, a detonation speed in a non-confined medium as cartridge in a rate from 3500 m/s to 5900 m/s and stable for a minimum period of 6 months. The explosive mixture of the embodiments of the present invention is used as a bait for initiation of nitrocarbonitrates primer and/or as a column loading in land blasting (rocks) of soft, semi hard, hard and very hard hardness in underground mining and/or open pit characterized as comprising:

An aqueous oxidizing solution of inorganic salts forming the dispersed phase wherein inorganic salts are:

- From 55% to 80% by weight of fertilizer grade ammonium nitrate as the largest component.
- From 0.1% to 16% by weight of sodium nitrate; and
- From 0.1% to 18% by weight of Thiourea;
- From 6% to 18% by weight of water;

A continuous combustible phase consisting of hydrocarbons of mineral, animal, vegetable origin or mixtures thereof, wherein the hydrocarbon of animal origin is shark oil, anchovy oil, whale oil, cod liver oil, seal oil, lard oil, snake oil and mixtures thereof; vegetable oil is olive oil, soybean oil, palm oil, sunflower oil, cottonseed oil, rapeseed or mustard oil, linseed oil, coconut oil and mixtures thereof and where the hydrocarbons may be in their liquid or solid nature and wherein the continuous combustible phase includes an agent or a surfactant agent mixture of nonionic or polymeric nature comprising:

- From 10% to 38% by weight of emulsifier of nonionic, polymeric nature or mixtures thereof, preferably polyisobutylene succinic anhydride sorbitan monooleate or mixtures thereof;
- From 0.1% to 10% by weight of mineral, vegetable or animal origin oil
- From 0.1% to 60% by weight of microcrystalline wax.
- From 0.1% to 50% by weight of paraffin
- From 10% to 20% of candelilla wax of vegetable origin which confers the proper consistency, with a viscosity of the matrix emulsion of 40000 cP to 150000 cP and that allows the retention of the nitrogen bubbles after the gasification in the cartridge avoiding its coalescence.

A mixture of ammonium nitrate granules (prills) of fertilizer grade of density from 0.85 g/cm3 to 1.0 g/cm3 containing in a ratio of 0.2 to 3% by total weight of the mixture, one oily liquid solution at 80% of a hydrocarbon solvent based on n-alkane and isoalkanes of chain C 12 to C 15 having a density of 0.82 g/cm3 at 0.86 g/cm3 and a viscosity of 200 cP to improve the water resistance of the ammonium nitrate and inhibit its reaction with the water of the dispersed phase of the emulsion, avoiding destabilization of the explosive mixture.

The matrix emulsion is sensitized with microsphere corpuscles (microball) of glass, ceramic, plastic, and mixtures thereof in the ratio of 0.1% to 3% by weight and mixed with the mixture produced in the granular ammonium nitrate (prill) of fertilizer grade and the hydrocarbon liquid solvent based on n-alkane and iso-alkane in the ratio of 50% to 95% by weight of the explosive emulsion and 50% to 5% by weight of the mixture of granular ammonium nitrate (prills) as an agent to increase the energy and volume of gases in the explosive mixture.

A carbonating agent comprising a solution of oxidizing salt of sodium nitrite having a pH of 6.0 to 8.0; which is mixed with the emulsion explosive mass and the granular ammonium nitrate prior to its packing in the packing machine in the ratio of 97.5% to 99.8% by weight of explosive mass and 2.5% to 0, 2% by weight of the sodium nitrite gasifying agent at a temperature of 70° C. to 90° C. obtaining a final explosive having a density from 0.95 g/cm3 to 1.25 g/cm3.

The embodiments of the invention are also directed to a process for producing an explosive mixture based on a dispersion of water in oil (emulsion) and ammonium nitrate granules (prills) of fertilizer grade, wherein the process comprises the steps of:

a) Dissolving the oxidizing salts in water between 80° C. to 90° C. comprising: ammonium nitrate and/or sodium nitrate, or mixtures thereof, thiourea and water in a first tank, with stirring.

b) Preparing the combustible solution at a temperature between 70° C. to 90° C. comprising: emulsifier of a nonionic nature, such as, for example, sorbitan monooleate, and/or polymer or mixtures thereof, mineral, vegetable or animal oil, paraffin, microcrystalline wax and candelilla wax in a second tank by stirring.

c) Mix 90% to 95% of oxidizing solution with 10% to 5% by weight of the combustible solution at a high speed of rotation between 400 rpm and 2000 rpm to form the non-explosive emulsion at a temperature between 70° C. and 90° C. with a particle size of less than 5 microns and with physicochemical characteristics of density (1.38 g/cm3 to 1.46 g/cm3), pH (3.0 to 6.0).

d) Mix in a mixer at a speed of 50 rpm to 200 rpm granular ammonium nitrate (prill) of fertilizer grade of density 0.85 g/cm3 to 1.0 g/cm3 with 0.2 to 3% of oily solution at 80% of liquid hydrocarbon based on n-alkane and isoalkanes of C 10 to C 15 chain with a density of 0.82 g/cm3 at 0.86 g/cm3 and a viscosity of 200 cP.

e) Mix in a mixer at a speed of 50 rpm to 300 rpm the matrix emulsion with the glass, ceramic, and/or plastic microspheres or mixtures thereof; in the ratio 97% to 99.9% by weight of matrix emulsion and 0.1% to 3% by weight of microspheres and the mixture produced between granular ammonium nitrate (prill) of fertilizer grade and the liquid hydrocarbon solvent in the ratio of 50% to 95% by weight of the sensitized emulsion and 50% to 5% by weight of the granular ammonium nitrate mixture (prills) prior to the reaction step of the granulated mixture sensitized with the sodium nitrite gasifying agent.

f) Mix in a mixer at a speed from 500 rpm to 1500 rpm the explosive mass of matrix emulsion with the microspheres and granular ammonium nitrate (prill) of fertilizer grade with a solution of sodium nitrite oxidizing salt with a pH of 6.0 to 8.0 before being packaged in the cartridge machine in the ratio of 97.5% to 99.8% by weight of explosive mass and 2.5% to 0.2% by weight of the sodium nitrite gasifying agent at a temperature from 70° C. to 90° C. obtaining a final explosive having a density from 0.95 g/cm3 to 1.25 g/cm3.

The following example illustrates a preferred method to carry out the embodiments of the present invention (Applicant notes that that this is a preferred embodiment but is not the only embodiment and is not intended to be a limiting example as understood by a person of ordinary still in the explosives art):

Example 1 a. The oxidizing phase is prepared in a tank equipped with a heating system and a stirring system, 79.11 parts by weight of ammonium nitrate, 8.90 parts by weight of sodium nitrate, 1.09 parts by weight of thiourea and 10.90 parts by weight of water at a temperature between 80° C. and 90° C. are dissolved.

b. For the combustible phase, a mixture of 26.50 parts by weight of surfactant agent based on polyisobutylene succinic anhydride (PIBSA), 7.40 parts by weight of Sorbitan Monooleate, 18.70 parts by weight of microcrystalline wax, 29.4 parts by weight of paraffin and 15.0 parts by weight of candelilla and 3.0 parts by weight of mineral oil are melted and homogenized between 70° C. and 90° C. in another tank with a heating and stirring system.

c. The mixture between granulated ammonium nitrate (prill) of fertilizer grade and oily solution at 80% of a liquid hydrocarbon n-alkane and isoalkane C12-C15 of chain is prepared in a mixer. The ratio of these mixtures is 98/2, respectively.

d. In emulsion preparation, the oxidizing phase (a) and combustible phase (b) are introduced into a high speed emulsifying tank of shear, 1200 rpm, where the emulsion matrix is formed at a temperature between 75° C. and 85° C.

e. Once a homogeneous matrix emulsion (d) of density 1.35 g/cm3 and viscosity 80 000 cP has been obtained, it passes to a mixer working at 100 rpm, where 1.3 parts by weight of plastic microsphere and 29.46 parts by weight of the mixture between granulated ammonium nitrate of fertilizer grade and the oily solution (c) are introduced. Before the cartridge filling, 0.5 parts by weight of the sodium nitrite gasifying agent are added to obtain an explosive mixture with a density in the range of 0.95 g/cm3 to 1.25 g/cm3.

TABLE I

| | Formula 1 | Formula 2 | Formula 3 |
|---|---|---|---|
| MATRIX EMULSION | % | % | % |
| AMMONIUM NITRATE | 74.2 | 74.2 | 74.2 |
| THIOUREA | 1.0 | 1.0 | 1.0 |
| WATER | 10.0 | 10.0 | 10.0 |
| SODIUM NITRATE | 8.0 | 8.0 | 8.0 |
| EMULSIFYING PIBSA | 1.3 | 1.3 | 1.3 |
| SMO | 0.5 | 0.5 | 0.5 |
| MICROCRYSTALLINE WAX | 1.0 | 1.0 | 1.0 |
| PARAFFIN | 2.0 | 2.0 | 2.0 |
| OIL | 1.2 | 1.2 | 1.2 |
| CANDELILLA WAX | 0.8 | 0.8 | 0.8 |
| AMMONIUM NITRATE FERTILIZER WITH ADDITIVES | | | |
| AMMONIUM NITRATE FERTILIZER OF HIGH DENSITY ($\rho$ = 0.95 g/cm$^3$) | 97.0 | 98.0 | 98.5 |
| N-ALKALINE/ISOALKANE HYDROCARBON C12-C15 | 3.0 | 2.0 | 1.5 |
| EXPLOSIVE MIXTURE RATIO | | | |
| MATRIX EMULSION | 58.92 | 68.74 | 78.56 |
| AMMONIUM NITRATE | 39.28 | 29.46 | 19.64 |

TABLE I-continued

| | Formula 1 | Formula 2 | Formula 3 |
|---|---|---|---|
| FERTILIZER WITH ADDITIVES | | | |
| PLASTIC MICROSPHERE | 1.3 | 1.3 | 1.3 |
| SODIUM NITRITE | 0.5 | 0.5 | 0.5 |
| RESULTS | | | |
| Cartridge density (g/cm$^3$) | 1.13 | 1.13 | 1.12 |
| Sensitive to No. 8 Detonator | Yes | Yes | Yes |
| Detonation Speed (m/s) | 4514 | 4404 | 4617 |
| Detonation wave transmission (ø) | 2.0 | 1.5 | 1.5 |
| Shelf life (months) | 9 | 7 | 4 |
| Breaking power Hess (mm) | 29 | 22 | 19 |
| Gas volume (L/Kg) | 1235 | 1025 | 1017 |

The invention claimed is:

1. A granular explosive mixture comprising:

an aqueous oxidizing solution of inorganic salts forming the dispersed phase where these inorganic salts are:
from 55% to 80% by weight of ammonium nitrate of fertilizer grade as the largest component;
from 0.1% to 16% by weight of sodium nitrate;
from 0.1% to 3.5% by weight of thiourea; and
from 6% to 18% by weight of water;

a continuous combustible phase formed by mineral, animal, vegetable hydrocarbons or mixtures thereof, where the hydrocarbon of animal origin includes shark oil, anchovy oil, whale oil, cod liver oil, seal oil, lard oil, snake oil and mixtures thereof; vegetable oil includes olive oil, soybean oil, palm oil, sunflower oil, cottonseed oil, rapeseed or mustard oil, linseed oil, coconut oil and mixtures thereof and where such hydrocarbons may be in their liquid or solid nature and where such continuous combustible phase includes an agent or a surfactant agent mixture of a non-ionic or polymeric nature comprising:

from 10% to 38% by weight of a non-ionic nature emulsifying, polymeric or mixtures thereof; selected from polyisobutylene succinic anhydride, sorbitan monooleate and mixtures thereof;

from 0.1% to 10% by weight of mineral, vegetable or animal oil;

from 0.1% to 60% by weight of microcrystalline wax;

from 0.1% to 50% by weight of paraffin;

from 10% to 20% of candelilla wax of vegetable origin with a viscosity of the matrix emulsion of 40000 cP to 150000 cP and that allows the retention of the nitrogen bubbles after the gasification in the cartridge avoiding its coalescence; and an 80% oily liquid solution of a hydrocarbon solvent based on n-alkane and iso-alkalines of C12 to C15 chain a density of 0.82 g/cm3 to 0.86 g/cm3 containing ammonium nitrate granules (prills) of fertilizer grade in a ratio of 0.2% to 3% by weight of the total ammonium nitrate mixture (prills) and a viscosity of 200 cP; wherein the explosive mixture is mechanically sensitized with microsphere corpuscles (microball) of glass, ceramics, plastic and mixtures thereof in the ratio of 0.1% to 3% by weight and the liquid hydrocarbon solvent based on n-alkane and iso-alkane in the ratio of 50% to 95% by weight of the explosive emulsion and 50% to 5% by weight of granulated ammonium nitrate mixture (prills), wherein encased in a water dispersion in oil (emulsion) and ammonium nitrate (prills) granules, fertilizer grade, sensitive to detonator No. 8, with gas volume (L/kg) between 1000 and 1250 and a breaking power Hess (mm) between 15 and 30.

2. A granular explosive mixture comprising:

an aqueous oxidizing solution of inorganic salts forming the dispersed phase where these inorganic salts are;
from 55% to 80% by weight of ammonium nitrate of fertilizer grade as the largest component;
from 0.1% to 16% by weight of sodium nitrate;
from 0.1% to 3.5% by weight of Thiourea;
from 6% to 18% by weight of water;

a continuous combustible phase formed by hydrocarbons of mineral, animal, or vegetable origin or mixtures thereof, where the hydrocarbon of animal origin includes shark oil, anchovy oil, whale oil, cod liver oil, seal oil, lard oil, snake oil and mixtures thereof; vegetable oil includes olive oil, soybean oil, palm oil, sunflower oil, cottonseed oil, rapeseed or mustard oil, linseed oil, coconut oil and mixtures thereof and where such hydrocarbons may be in their liquid or solid nature and where that continuous combustible phase includes an agent or a mixture of a surfactant agent of a non-ionic or polymer nature comprising:

from 10% to 38% by weight of emulsifier of non-ionic polymeric nature or mixtures thereof, selected from polybutylene succinic anhydride, sorbitan monooleate and mixtures thereof;

from 0.1% to 10% by weight of oil of mineral, vegetable or animal origin;

from 0.1% to 60% by weight of microcrystalline wax;

from 0.1% to 50% by weight of paraffin;

from 10% to 20% is candelilla wax of vegetable origin which confers it the appropriate consistency, with a viscosity of the matrix emulsion between 40000 cP and 150000 cP, and which allows retention of the nitrogen bubbles after gasification in the cartridge, avoiding its coalescence; and an oily liquid solution at 80% of a hydrocarbon solvent based on n-alkane and iso-alkanes of C12 to C15 chain, with a density of between 0.82 g/cm3 and 0.86 g/cm3 that contains ammonium nitrate granules (prills) of fertilizer grade in a ratio of 0.2% to 3% by weight of the total ammonium nitrate (prills) mixture and a viscosity of 200 cP, where the explosive mixture is sensitized with a bubble generation chemical reaction (gasification) when adding a gasifying agent that comprises a sodium nitrite oxidizing salt solution, wherein the mixture is encased based on a water dispersion in oil (emulsion) and ammonium nitrate granules (prills) of fertilizer grade, sensitive to No. 8 detonator, with gas volume (L/kg) between 1000 and 1250 and a breaking power Hess (mm) between 15 and 30.

3. A granular explosive mixture according to claim 2, wherein the sodium nitrite gasifying agent has a pH of 6.0 to 8.0; and it is mixed with the emulsified explosive mass and the granulated ammonium nitrate prior to its packaging in the weight ratio between 97.5% and 99.8% of explosive mass and 2.5% to 0.2% of the sodium nitrite gasifying agent at a temperature of 70° C. to 90° C.

4. A packaged granular explosive mixture comprising:

an aqueous oxidizing solution of inorganic salts which forms the dispersed phase where the inorganic salts comprise:
From 55% to 80% by weight of ammonium nitrate of fertilizer grade, considered as the largest component;
From 0.1% to 16% by weight of sodium nitrate; and
From 0.1% to 3.5% by weight of Thiourea;
From 6% to 18% by weight of water;

a continuous combustible phase comprising hydrocarbons of mineral, animal or vegetable origin or mixtures thereof, wherein the hydrocarbon of animal origin includes shark oil, anchovy oil, whale oil, cod liver oil, seal oil, lard oil, snake oil and mixtures thereof; the vegetable oil includes olive oil, soybean oil, palm oil, sunflower oil, cottonseed oil, rapeseed or mustard oil, linseed oil, coconut oil and mixtures thereof and where the hydrocarbons may be in their liquid or solid nature and wherein the continuous combustible phase includes an agent or a mixture of surfactant agent of non-ionic or polymeric nature that comprises:

From 10% to 38% by weight of emulsifier of nonionic, polymeric nature or mixtures thereof, polyisobutylene succinic anhydride, sorbitan monooleate and mixtures thereof;

From 0.1% to 10% by weight of mineral oil, vegetable or animal origin;

From 0.1% to 60% by weight of microcrystalline wax;

From 0.1% to 50% by weight of paraffin;

From 10% to 20% of candelilla wax of vegetable origin which confers it the appropriate consistency, with a viscosity of the matrix emulsion between 40000 cP and 150000 cP and that allows the retention of the nitrogen bubbles after gasification in the cartridge, avoiding its coalescence; and a mixture of ammonium nitrate granules (prills) of fertilizer grade containing a ratio of 0.2 to 3% of weight of the overall mixture, an oily liquid solution at 80% of a hydrocarbon solvent based on n-alkane and iso-alkanes of C12 to C15 chain with a density of 0.82 g/cm3 to 0.86 g/cm3 and a viscosity of 200 Cp, wherein the matrix emulsion is made sensitive with a combination of mechanical sensitization when adding microsphere corpuscles (microball) of glass, ceramic, plastic or mixtures thereof in the ratio of 0.1% to 3% by weight of the overall mixture and a mixture of the explosive emulsion and the ammonium nitrate granules (prills) of fertilizer grade in the ratio of 50% to 95% by weight of the explosive emulsion and from 50% to 5% by weight of the mixture of granulated ammonium nitrate (prills) and chemical sensitization when adding a gasifying agent which comprises a solution of sodium nitrite oxidizing salt with a pH of 6.0 to 8.0; which is mixed with the emulsion explosive mass and the granulated ammonium nitrate before being packaged in the cartridge machine in the ratio of 97.5% to 99.8% by weight of the explosive mass and 2.5% to 0.2% by weight of the sodium nitrite gasifying agent at a temperature from 70° C. to 90° C., wherein the mixture is based on a dispersion of water in oil (emulsion) and ammonium nitrate granules (prills) of fertilizer grade, sensitive to No. 8 detonator, with a volume of gases (L/kg) between 1000 and 1250 and a breaking power Hess (mm) of between 15 and 30.

5. A cartridge (chub) with a diameter from 2.22 cm ⅞" to 7.62 (3") and a length from 15.24 cm (6") to 60.96 cm (24") wherein the cartridge comprises a granular explosive mixture according to claim 1.

6. A cartridge (chub) with a diameter from 2.22 cm ⅞" to 7.62 (3") and a length from 15.24 cm (6") to 60.96 cm (24") wherein the cartridge comprises a granular explosive mixture according to claim 2.

7. A cartridge (chub) with a diameter from 2.22 cm ⅞" to 7.62 (3") and a length from 15.24 cm (6") to 60.96 cm (24") wherein the cartridge comprises a granular explosive mixture according to claim 4.

* * * * *